US007033271B2

(12) United States Patent
Gerow

(10) Patent No.: US 7,033,271 B2
(45) **Date of Patent: *Apr. 25, 2006**

(54) METHOD, APPARATUS AND GAMING SET FOR USE IN A PROGRESSIVE GAME

(75) Inventor: Jay E. Gerow, Bothell, WA (US)

(73) Assignee: ZDI Gaming, Inc., Lynnwood, WA (US)

( * ) Notice: Subject to any disclaimer, the term of this patent is extended or adjusted under 35 U.S.C. 154(b) by 236 days.

This patent is subject to a terminal disclaimer.

(21) Appl. No.: 10/627,579

(22) Filed: Jul. 24, 2003

(65) Prior Publication Data

US 2004/0116180 A1 Jun. 17, 2004

Related U.S. Application Data

(63) Continuation of application No. 10/003,679, filed on Oct. 29, 2001, now Pat. No. 6,599,187, which is a continuation of application No. 09/369,678, filed on Aug. 5, 1999, now Pat. No. 6,309,298, which is a continuation-in-part of application No. 08/898,553, filed on Jul. 22, 1997, now Pat. No. 5,944,606.

(51) Int. Cl.
*A63F 3/06* (2006.01)

(52) U.S. Cl. ..... 463/17; 273/139; 273/138.2; 273/138.1; 463/16; 463/18

(58) Field of Classification Search ..... 273/139, 273/138.1, 138.2, 143 R; 463/16, 17, 18, 463/20

See application file for complete search history.

(56) References Cited

U.S. PATENT DOCUMENTS 3,900,219 A 8/1975 D'Amato et al.
4,191,376 A 3/1980 Goldman et al.
4,323,770 A 4/1982 Dieulot et al.
4,373,726 A 2/1983 Churchill et al.

(Continued)

FOREIGN PATENT DOCUMENTS

GB 2 232 358 A 12/1990
JP 59-178573 10/1984

OTHER PUBLICATIONS

"Tab Force" brochure, Infinity Group, Inc., Albuquerque, New Mexico, Date Unknown.
Betty Boop Round Top Designs, Bally Gaming Systems, Date Unknown.
*Third Amendment to the Tribal/State Compact for Class III Gaming Between the Nooksack Indian Tribe and the State of Washington* (2 pages), Appendix X (46 pages) and *Tribal—State Compact for Class III Gaming Between the Nooksack Indian Tribe and the State of Washington* (pp. 4–7), dated Oct. 28, 1991.
Bally Gaming Slots, 1996–1998, 23 pages.
Protest Under 37 C.F.R. 1.1291(a) with Exhibits, 1996–1997.
*The Future of the Scratch Ticket is Here* brochure, Oasis Technologies, Inc., 1997.
Oasis ITVM Fact Sheet, 2 pages, 1997.
Oasis Lottery Game Center System, 1 page, 1997.

(Continued)

*Primary Examiner*—Benjamin Layno
(74) *Attorney, Agent, or Firm*—Kolisch Hartwell, P.C.

(57) ABSTRACT

Systems, methods and gaming sets for progressive games, including progressive pull-tab games. The gaming sets include a plurality of plays, which in some embodiments take the form of pull-tab cards, and in some embodiments are electronic plays. The plays are associated with indicia of redemption value, with the set of plays including at least one jackpot play of underdetermined total value prior to dispensing of the play, and at least one set of plays with a predetermined value.

40 Claims, 5 Drawing Sheets

U.S. PATENT DOCUMENTS

| | | | | |
|---|---|---|---|---|
| 4,669,729 | A | | 6/1987 | Solitt et al. |
| 4,689,742 | A | | 8/1987 | Troy et al. |
| 4,725,079 | A | | 2/1988 | Koza et al. |
| 4,740,016 | A | | 4/1988 | Konecny et al. |
| 4,764,666 | A | | 8/1988 | Bergeron |
| 4,817,949 | A | | 4/1989 | Bachman et al. |
| 4,832,341 | A | | 5/1989 | Muller et al. |
| 4,839,507 | A | | 6/1989 | May |
| 4,842,278 | A | | 6/1989 | Markowicz |
| 4,880,964 | A | | 11/1989 | Donahue |
| 4,943,090 | A | | 7/1990 | Fienberg |
| 4,982,337 | A | | 1/1991 | Burr et al. |
| 5,007,641 | A | | 4/1991 | Seidman |
| 5,039,848 | A | | 8/1991 | Stoken |
| 5,046,737 | A | | 9/1991 | Fienberg |
| 5,129,652 | A | | 7/1992 | Wilkinson |
| 5,290,033 | A | | 3/1994 | Bittner et al. |
| 5,324,035 | A | | 6/1994 | Morris et al. |
| 5,344,144 | A | | 9/1994 | Canon |
| 5,346,258 | A | | 9/1994 | Behm et al. |
| 5,348,299 | A | | 9/1994 | Clapper, Jr. |
| 5,377,975 | A | | 1/1995 | Clapper, Jr. |
| 5,407,199 | A | | 4/1995 | Gumina |
| 5,407,200 | A | | 4/1995 | Zalabak |
| 5,475,205 | A | | 12/1995 | Behm et al. |
| 5,487,544 | A | | 1/1996 | Clapper, Jr. |
| 5,536,008 | A | | 7/1996 | Clapper, Jr. |
| 5,536,016 | A | | 7/1996 | Thompson |
| 5,580,311 | A | | 12/1996 | Haste, III |
| 5,595,538 | A | | 1/1997 | Haste, III |
| 5,647,592 | A | | 7/1997 | Gerow |
| 5,657,899 | A | | 8/1997 | Stoken |
| 5,657,991 | A | | 8/1997 | Camarato |
| 5,682,819 | A | | 11/1997 | Beaty |
| 5,704,835 | A | | 1/1998 | Dietz, II |
| 5,735,432 | A | | 4/1998 | Stoken et al. |
| 5,915,588 | A | | 6/1999 | Stoken et al. |
| 5,927,541 | A | | 7/1999 | Stoken et al. |
| 5,934,671 | A | * | 8/1999 | Harrison ..... 273/139 |
| 5,949,042 | A | | 9/1999 | Dietz, II et al. |
| 6,309,298 | B1 | | 10/2001 | Gerow |

OTHER PUBLICATIONS

Oasis Technologies, Inc. Company Profile, 9 pages, 1997.
Bally Gaming, The World's Game Maker brochure, 1998.
Game Maker Slant–7200 product specification sheet, 1998.
ProSlant 6000 product specification sheet, 1999.
*In a Class By Itself an Instant Ticket Validation System* brochure, Infinity Group, Inc.

* cited by examiner

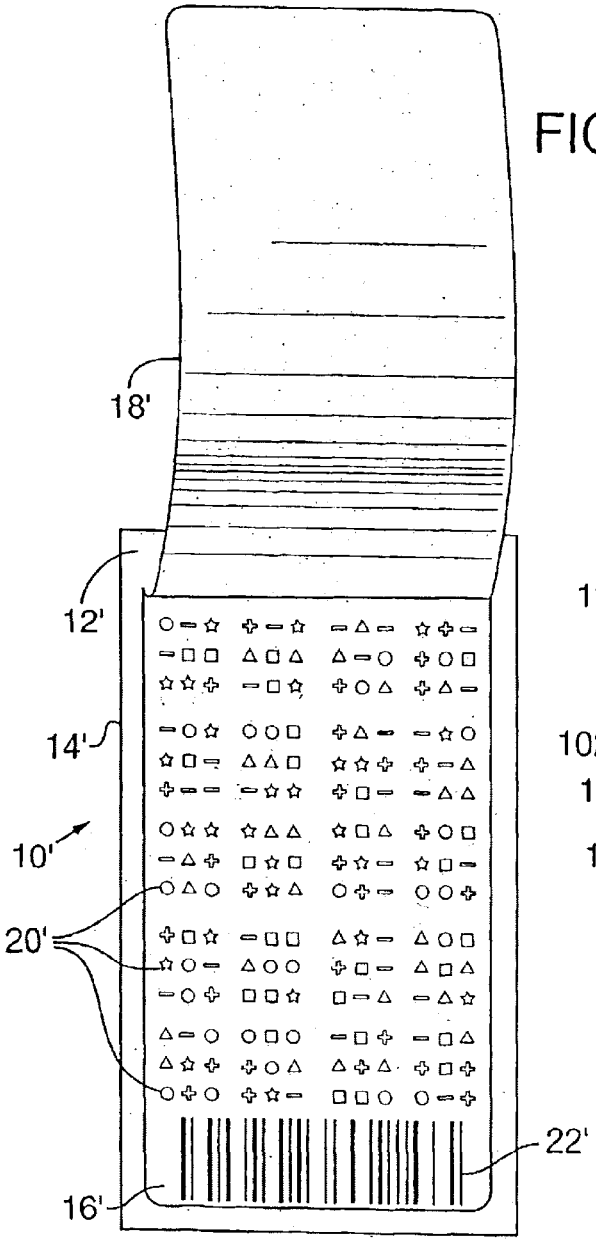
FIG. 7
FIG. 8
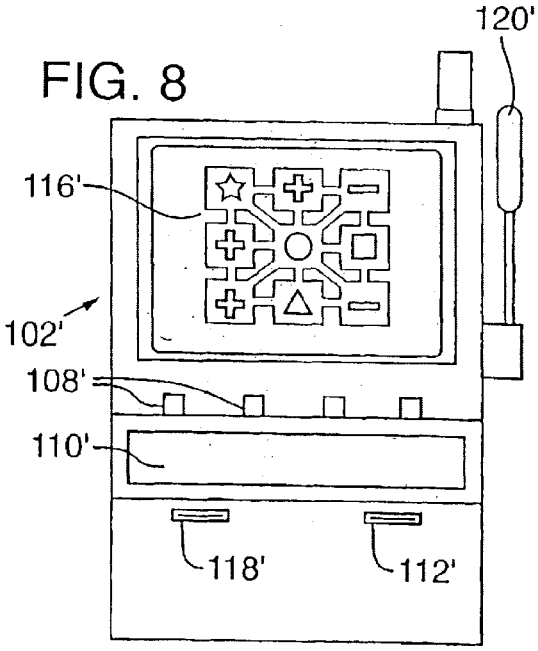

METHOD, APPARATUS AND GAMING SET FOR USE IN A PROGRESSIVE GAME

CROSS-REFERENCE TO RELATED APPLICATIONS

This application is a continuation of and claims priority to U.S. patent application Ser. No. 10/003,679, which was filed on Oct. 29, 2001 and issued on Jul. 29, 2003 as U.S. Pat. No. 6,599,187, and which is a continuation of U.S. patent application Ser. No. 09/369,678, which was filed on Aug. 5, 1999 and issued on Oct. 30, 2001 as U.S. Pat. No. 6,309,298, and which is a continuation-in-part of U.S. patent application Ser. No. 08/898,553, which was filed on Jul. 22, 1997 and issued on Aug. 31, 1999 as U.S. Pat. No. 5,944,606. The complete disclosures of the above-identified patent applications are hereby incorporated by reference for all purposes.

FIELD OF THE INVENTION

This invention relates generally to gaming. More particularly, the invention relates to a method, apparatus and gaming set for use in a progressive pull-tab game.

BACKGROUND

"Pull-tab" is a game of chance, commonly played in casinos and taverns. In a pull-tab game, participants purchase pull-tab cards from a large fixed pool or set. The game ends when the entire pool of cards has been purchased. The cards in a set are marked at the time of manufacture with various patterns of symbols or indicia. The indicia on the otherwise identical cards is covered when the cards are sold so that neither the operator nor player can see the indicia before the card is purchased. A certain number of cards in each set are manufactured with a pattern of indicia indicating that they are winners. Such winning cards will have a predetermined pay-off value: $1, $5, $1,000, etc. Other cards may have zero value.

The set of cards may be stored and distributed electronically as well as in printed form. In this case, the cards are stored and distributed in a predetermined order, just as with printed cards. Likewise, certain of the electronic cards are coded as winners and losers. Until the cards ate dispensed or displayed, it is not possible for a player to determine whether a particular electronic card is a winner, and, if so, its pay-off value.

The winning and losing cards are randomly mixed in the pool and externally identical. Therefore, the value of a card is not ascertainable prior to its opening or display upon purchase. Whether winner or loser, the value of each card is dependent only on the pattern of indicia printed thereon or associated therewith and therefore is predetermined at the time the cards are printed or generated. Because the number of winning cards in a set, and the value of each, is known, the operator of the game knows the total pay-out for a game in advance, as do the players.

In one variation of the standard pull-tab games, there are multiple separate indicia on or associated with each card. With these "multi-play" cards, which may have twenty plays on a single card, the player has many opportunities to win. With multiple plays on each card, each multi-play card may be a winner by including at least one winning play. The pay-off values for multi-play cards, however, are typically much smaller because of the many winning combinations. Multi-play cards may be sold at higher prices than single-play cards.

Games of chance can be described as either progressive or non-progressive. In non-progressive games, such as traditional pull-tab, participants play for a chance to win a predetermined prize, i.e., one of the winning cards. Progressive games, in contrast, involve a jackpot or prize that grows during the play of the game. Many state numbers lotteries, for instance, fall into the progressive category because the prize increases over time as more players participate. During the operation of a progressive game, a portion of each player's purchase is dedicated to the prize. Thus, the prize grows until the winning numbers are selected and the game ends. Some slot machines also offer a progressive jackpot.

While progressive games typically offer participants greater excitement and appeal because of the opportunity to win a larger prize, such games are more complex to operate. Moreover, not all games of chance lend themselves to a progressive implementation. Pull-tab, for instance, has not been amenable for implementation in a progressive game because of the use of a pre-printed or pre-generated set of cards with predetermined winning amounts.

Because of the popularity of traditional slot machines, which provide the player with an immediate visual indication of the outcome of a play, it is generally desirable to offer a pull-tab game which resembles a slot game. One principle way this has been achieved is by providing an automatic reader to read the cards as they are dispensed. Another way this has been achieved is by providing a separate reader to read the cards upon insertion of the cards into the reader by a player. In the case of electronic tickets, the status of the card is determined when it is displayed. In any case, the resulting play can then be depicted visually on a video display in a fashion replicating the appearance of a slot machine. When this type of system is used with a multi-play pull-tab card, a sequence of plays can be completed without interruption. However, because this system still uses pre-printed cards or pre-generated cards with predetermined values, it has not been amenable for implementation in a progressive format.

SUMMARY OF THE INVENTION

The present invention includes systems, methods and gaming sets for progressive games, including progressive pull-tab games. The gaming sets include a plurality of plays, which in some embodiments take the form of pull-tab cards, and in some embodiments are electronic plays. The plays are associated with indicia of redemption value, with the set of plays including at least one jackpot play of underdetermined total value prior to dispensing of the play, and at least one set of plays with a predetermined value.

Many other features, advantages and additional objects of the present invention will be apparent to those versed in the art upon making reference to the detailed description which follows and the accompanying sheets of drawings in which a preferred embodiment incorporating the principles of this invention is disclosed as an illustrative example only.

BRIEF DESCRIPTION OF THE DRAWINGS

FIG. 7 shows a multi-play pull-tab card constructed according to the present invention.

FIG. 8 shows a dispensing unit according to the present invention.

DETAILED DESCRIPTION OF THE PREFERRED EMBODIMENT

Figure 1A:
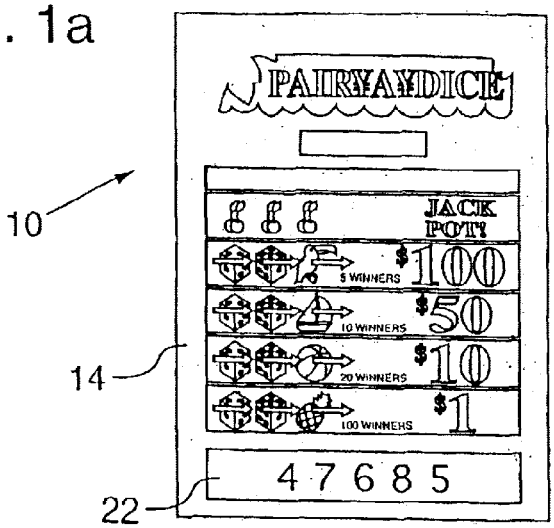
FIG. 1*a* shows a backside of a pull-tab card constructed according to the present invention.
Figure 1B:
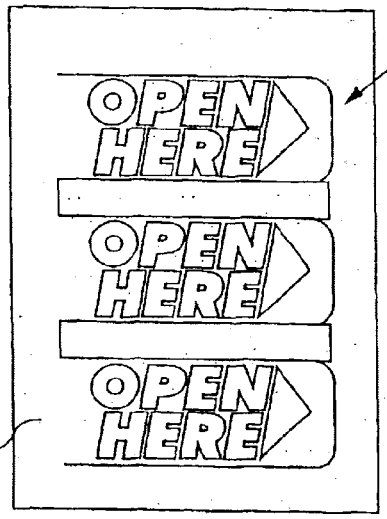
FIG. 1*b* shows a front side of the pull-tab card of FIG. 1*a*.
Figure 1C:
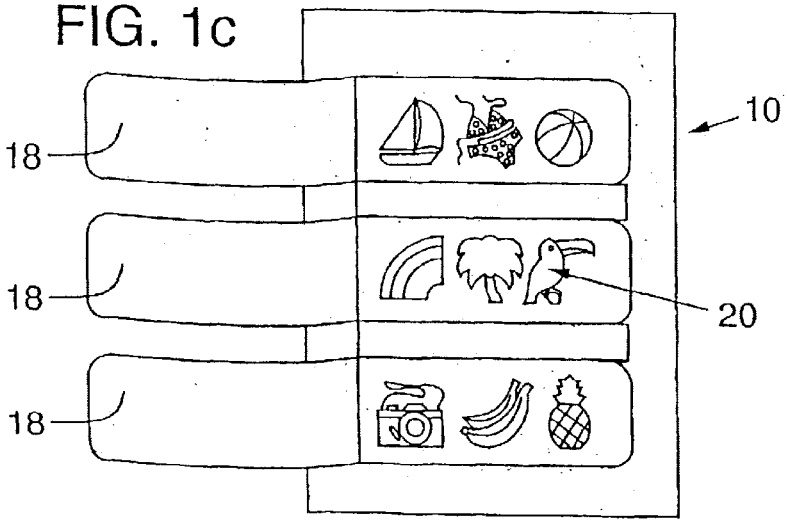
FIG. 1*c* shows the front side of the pull-tab card of FIG. 1*a*, showing lifted serrated flaps.
Figure 2:
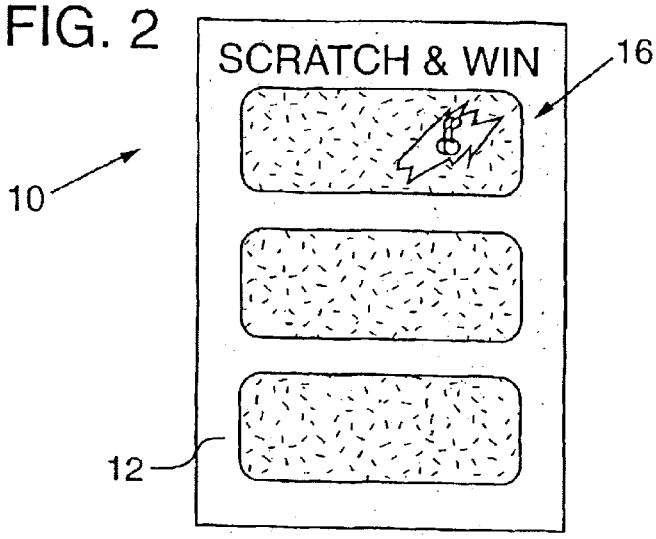
FIG. 2 shows a pull-tab card with a scratch-off coating suitable for use in the present invention.

A printed pull-tab card for use with the present invention is shown generally at 10 in FIGS. 1*a–c*. Card 10 includes a front side 12 and a back side 14, with a selectively revealable gaming section 16 disposed on the front side. The gaming section, in the preferred embodiment, includes three serrated flaps 18 that can be lifted to reveal underlying indicia 20 of the value of the card. Although serrated regions are preferred, any other suitable selectively revealable region could be used, including, among others, scratch-off coatings, such as shown in FIG. 2, or a separable two-part card, such as shown in U.S. Pat. No. 5,348,299 which is incorporated herein by reference.

Pull-tab cards according to the present invention can also be implemented and dispensed electronically, as described in U.S. Pat. No. 5,324,035 which is incorporated herein by reference. Electronic cards or tickets are generally designed to mimic the format and appearance of printed cards. Such electronic cards are typically distributed through electronic display terminals with touch-screens to allow a player to control exposure of the gaming region.

Figure 3:
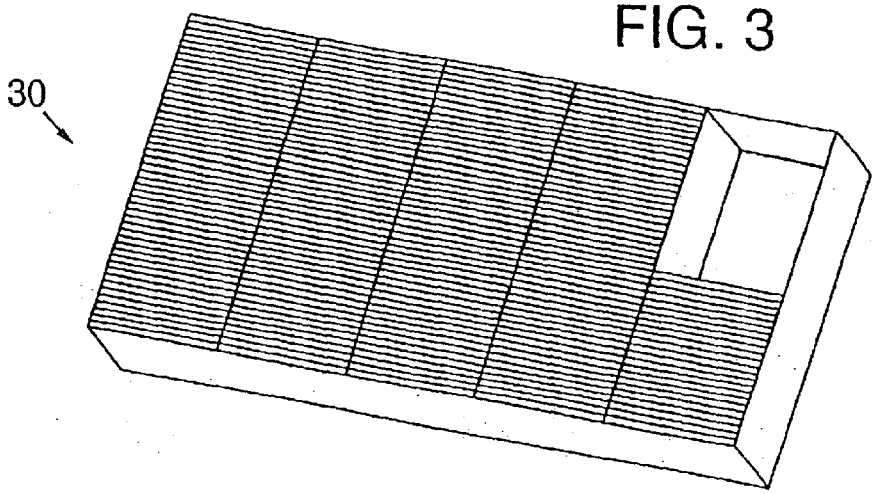
FIG. 3 is a perspective view of a pull-tab gaming set according to the present invention.

In the context of the preferred embodiment of the present invention, pull-tab cards or plays, such as card 10, typically form part of a pull-tab gaming set as shown generally at 30 in FIG. 3. With electronic tickets, the set or pool is, of course, stored electronically. Card 10 also typically includes a printed gaming code 22, which is different for each set and therefore can be used to distinguish cards from different sets. Set 30 preferably includes three classes of cards. The first class, which usually constitutes the majority of the cards, is losers. Losing cards, such as card 10 in FIG. 1*c*, are those that have no redemption value. The losing cards may be considered as having a predetermined value, even though that value is $0.

Figure 4A:
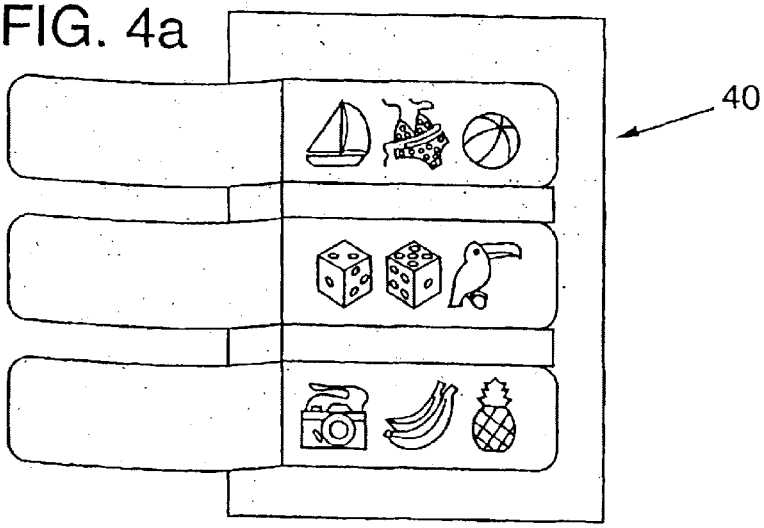
FIGS. 4*a–b* show a winning card and a jackpot card according to the present invention.

The second class of cards in set 30 is winners, which have fixed non-zero values. Winner cards include an indicia of the amount of their redemption value. For example, a card in the winner class may have a value of $100, such as winner card 40 shown in FIG. 4*a*. Thus, a player receiving that card could redeem it with the operator of the game for $100. In some cases a single card may have more than one set of winning indicia. For instance, the top line of symbols in FIG. 4*a* could represent a winning combination in addition to the second line of symbols. In the preferred embodiment, there are a number of different sub-classes within the winner class, and each sub-class has a different fixed value. In a typical set consisting of 4,000 cards selling for $1 each, there might be 100 cards in the $1 sub-class, 20 cards in the $10 sub-class, 10 cards in the $50 sub-class, 5 cards in the $100 sub-class and so on. Most commonly, there are fewer cards in the higher value sub-classes and more cards in the lower value sub-classes, although this is not essential.

Figure 4B:
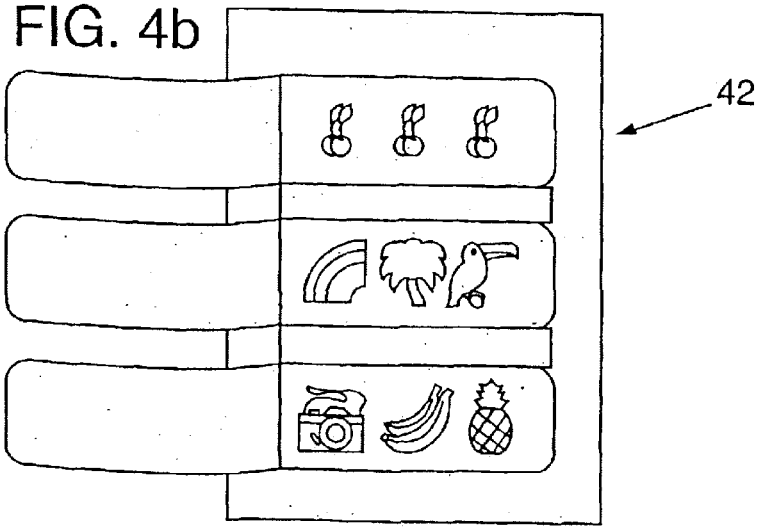

The third class in set 30 is the jackpot. In the preferred embodiment, there is only one jackpot card, shown at 42 in FIG. 4*b*, although there could be two or more jackpot cards as desired. The jackpot card has an undetermined redemption value. Thus, until the jackpot card is received by a player, it is not possible to determine what its value will be. The value of the jackpot card is determined only during the play of the game, as will be described below. In the preferred embodiment of the present invention, as will be described in more detail below, the value of the jackpot card will go up during the play of the game. It is this increasing jackpot card value that provides the progressive aspect of the present invention.

As mentioned above, each card in the set includes an indicia of its value. With printed cards, a shown in FIG. 1*a*, the back side of each card is preferably printed with a chart listing the indicia for each sub-class of winning cards as well as the jackpot class. The chart also lists the number of cards in each class and sub-class, and the value associated with each sub-class of the winning class. Any card bearing an indicia other than those listed on the chart is a loser. Thus, a player receiving a card will tear open the serrated section to reveal the gaming section and indicia printed therein. By comparing the indicia in the gaming section with those listed on the chart, the player can determine the class/sub-class of the card. For all cards other than the jackpot card, the player will also know the value of the card. The jackpot card has indicia from which the player can identify it as a jackpot card, but has an undetermined redemption value. In the case of electronic cards, the "backside" of the card can be displayed next to the front on the display screen.

Figure 5:
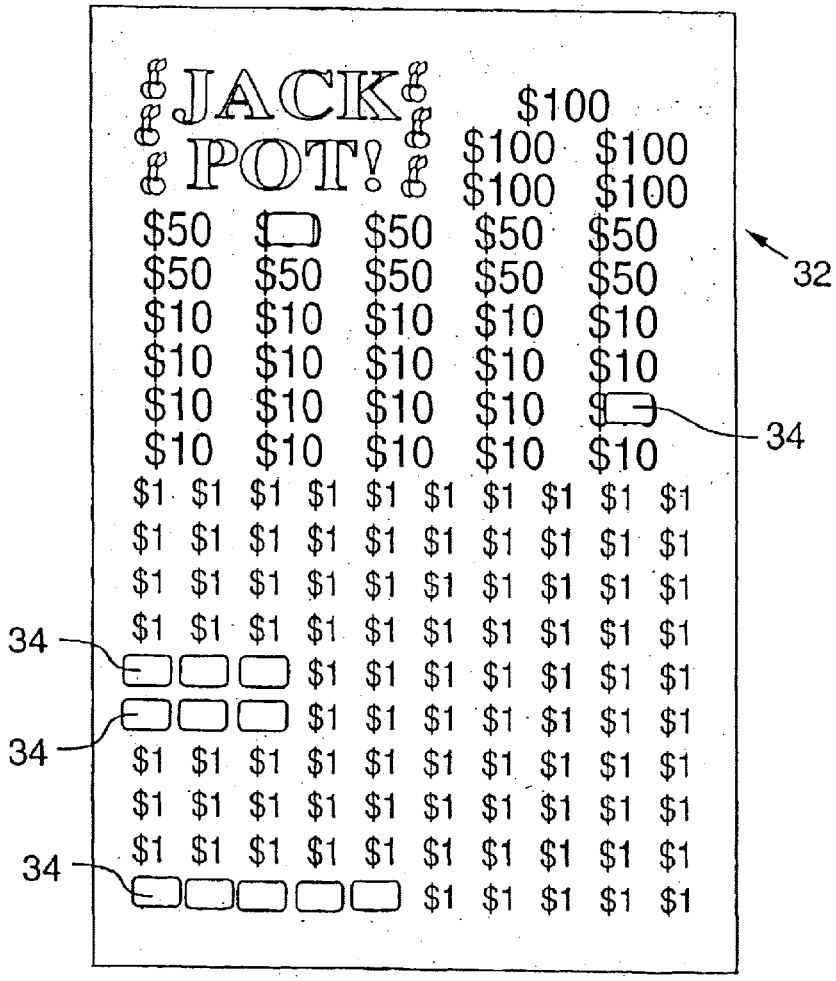
FIG. 5 is a sign for use with the present invention.

A sign or poster 32, such as shown in FIG. 5, is normally provided in the general area where the cards are being dispensed to allow players to monitor what winning cards remain to be distributed. The sign includes a listing of each of the winning cards, and, as each winning card is redeemed, the operator of the game covers one of the listings for that sub-class of card, as shown at 34. Although this procedure is not required, it allows a player to glance at the sign and determine the number and type of winning cards remaining. Such a sign may also be displayed on an electronic display screen with or separate from a display of an electronic ticket.

In a variation on the pull-tab cards described above, the present invention could be implemented utilizing multi-play pull-tab cards such as shown at 10' in FIG. 7. Card 10' would typically include a front side 12', a back side 14' and a selectively revealable gaming section 16'. The gaming section is disposed beneath a serrated flap 18' that can be lifted to reveal the gaming section. The principal difference between card 10' and previously described card 10 is that card 10' includes multiple plays, rather than the single play provided by card 10. Specifically, in the version depicted, card 10' provides twenty different indicia in the form of groups 20' of nine symbols each, where each group represents a play. For each group, the player can evaluate whether a winning combination is present. The symbols of each group may be read horizontally, vertically or diagonally to evaluate whether a winning combination is present, further enhancing the play.

Either card 10 or 10' may be configured to be machine readable. As shown in FIG. 7, this may take the form of a bar code 22' printed on the card. Alternatively, the machine may be able to read the groups of indicia directly. However, one of the benefits of the bar code is the difficulty of tampering which is not provided if the indicia are scanned directly. Preferably, the machine readable portion is not readable until the card is opened, thereby reducing the risk that an unscrupulous proprietor would search for and remove winning cards. One example of a suitable card is shown in U.S. Pat. No. 5,290,033, which is incorporated herein by reference. Of course in the case of electronic cards, the electronic data constituting the card provides the device with sufficient information to determine whether the card is a winner or not.

Figure 6:
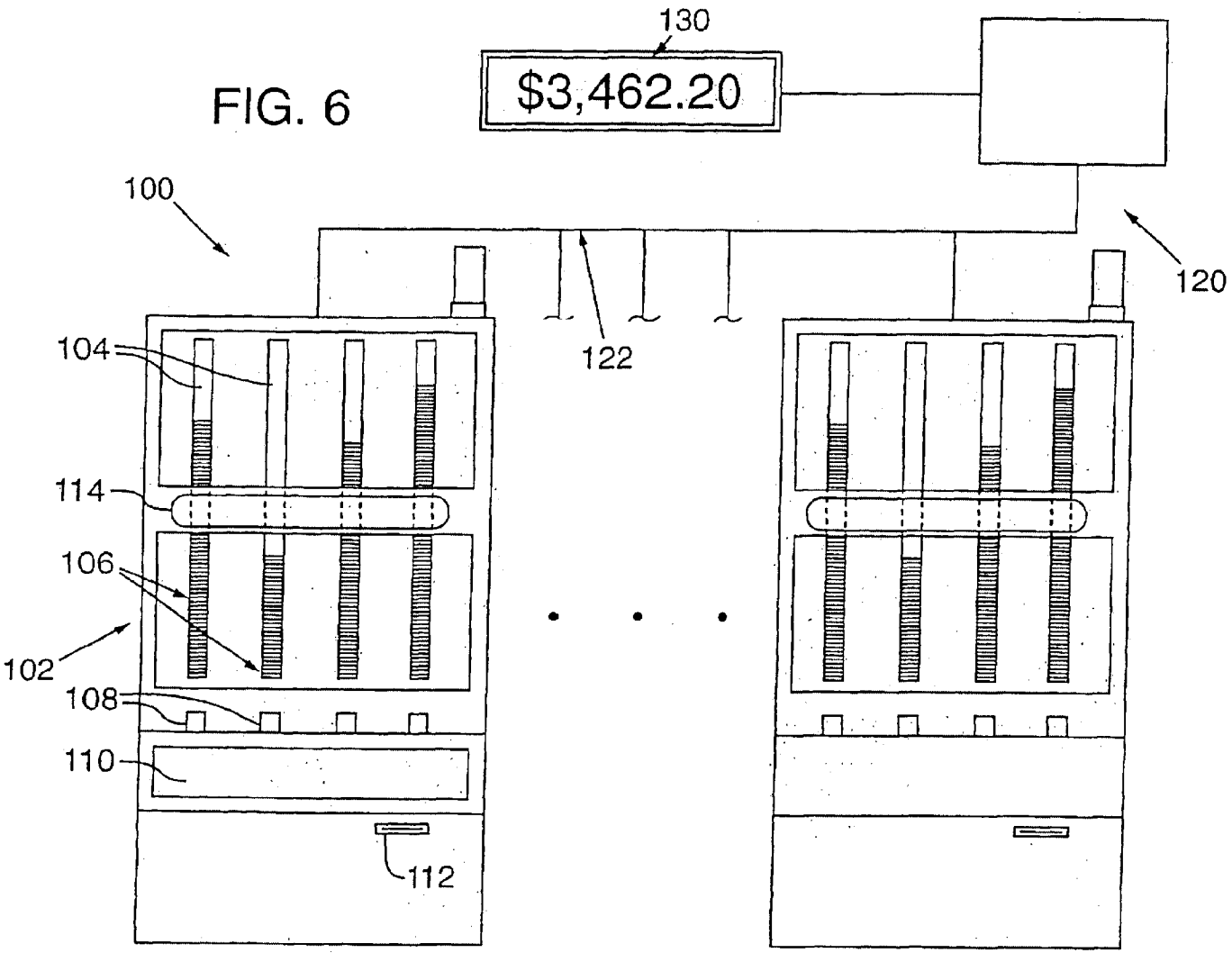
FIG. 6 is a progressive pull-tab gaming system constructed according to the present invention.

A system for conducting a progressive pull-tab game according to the present invention is shown generally at 100 in FIG. 6. System 100 typically includes one or more dispensing units, such as unit 102, configured to dispense pull-tab cards. In the preferred embodiment, unit 102 is a Lucky Pick Model No. LP1, sold by Over and Under Int'l Inc., of Clarkston, Wash., with a serial communications chip added to enable communication with a computer as will be subsequently described, although any other pull-tab dispensing unit could be made suitable for use in the present invention with minor modification. Each unit is essentially identical and the subsequent description will be made with particular reference to unit 102. A typical unit, such as unit 102, would be able to hold approximately 4,000 pull-tab cards. This amount may represent an entire pull-tab gaming set, or a set may fill two or more units. Unit 102 holds cards in four racks 104, and the cards in each rack are visible through an overlying window 106. Having the cards visible allows the player to evaluate approximately how many cards remain. By comparing the number of remaining cards with the number of remaining winning cards as indicated on poster 32, as described above, the player is able to estimate the odds of receiving a winning card.

Beneath each window is a button 108 that the player can push to dispense a card from the above stack. Providing the player the ability to select the stacks gives the player some sense of control over the game. After the player selects the stack, the card is dispensed into a bin 110 disposed beneath the buttons. Players pay for cards using a bill validator 112 built into the unit. A display 114 is provided to inform the player of how much credit they have remaining from money put into the bill validator. Thus, a player can feed the bill validator $20 to purchase twenty tickets at once. The cards, however, are only dispensed one at a time as the player selects and pushes one of the four buttons.

In the case of electronic cards, the cards are dispensed at terminals equipped with electronic display screens. The terminals typically allow a user to select among different games and provide the user with game information such as the number of plays remaining in the current pool or set of plays. Because the tickets or plays are stored and presented electronically, the terminal can determine whether or not any particular ticket is a winner. In addition to presenting an image indicative of the value or pay out for the card in the course of dispensing, the terminal can also directly report winnings and can print a validation receipt for redemption by a cashier for winning cards. Typical display screen images for electronically dispensed cards are shown in FIGS. 14–17 in U.S. Pat. No. 5,324,035, incorporated by reference above.

System 100 includes a control system 120 to which each of the units are operatively connected, such as by a serial cable 122. In the preferred embodiment, control system 120 is an IBM compatible computer running software known as Progressive Pull-Tab Version 1.3, produced by Paradise Valley Electronics, of Moscow, Id., that allows the control system to communicate with each of the dispensing units, although any suitable software could be used. Control system 120 monitors the quantity of pull-tab cards dispensed by the dispensing units. In the preferred embodiment, each unit signals the control system when a player purchases cards and when a card is dispensed. Also in the preferred embodiment, the control system is physically separated from the dispensing units, but it could just as well be incorporated in one of the dispensing units, or each unit could have its own control system. As an additional alternative, cards could be directly sold and distributed by a cashier or operator.

System 100 also includes a jackpot display 130 operatively connected to the control system to display a jackpot value. In the preferred embodiment, the software on the control system keeps track of the jackpot value and sends information to the jackpot display. The redemption value of the jackpot card is determined by the jackpot value. In the preferred embodiment of the invention, the jackpot is set to a predetermined value at the beginning of the game, that is, when a new set of cards is loaded into the system to be dispensed. As the control system receives signals indicating sale of cards, it increases the jackpot value. For instance, the jackpot value may be incremented by five-percent of the price of each card, as they are sold. Although the jackpot value is incremented for every card sale in the preferred embodiment, it could be incremented less frequently, or additionally on occurrence of other events. For example, the jackpot could be incremented once for every five card sales or once every fifteen minutes, or both. In the preferred embodiment, the jackpot value is incremented by and stored in software in the computer, but the jackpot could be as simple as a mechanical counter that was incremented for every ticket sale or some fraction thereof.

An alternative embodiment of a dispensing unit according to the present invention is shown generally at 102' in FIG. 8. Dispensing unit 102' is generally similar to dispensing unit 102 and includes racks (not shown) to hold a stock of pull-tab cards from which the player can select using buttons 108'. Most significantly, dispensing unit 102' also includes an electronic video display 116' and a card reader 118'. The card reader is configured to receive a card from a player. By reading some type of marking or property of the card, the card reader is able to determine whether the card is a winner, loser or jackpot card. Of course, with electronic cards, no reader is required. After the card is read, the dispensing unit then displays a pattern of images on the video display corresponding to the character of the card. The image may be a representation of a printed card based upon the card read by the reader or the electronic card. Preferably, the display mimics the appearance of the wheels on a slot machine so that the player is given the look and feel of playing slots. The display may be a video display, actual spinning wheels, or other types of display. A pull-down arm, such as arm 120', may also be attached to the machine to actuate the reading of a card, when it is pulled, similar to an arm on a slot machine, to simulate the play of a slot machine. Alternatively, the card may be read automatically upon insertion, or upon actuation of some other trigger. This type of system is particularly beneficial when implemented with the multi-play cards because the player can run through a sequence of plays without purchasing or inserting additional cards. Preferably the jackpot value would be displayed on the video display in addition to or alternatively to jackpot display 130.

Although the above-described alternative embodiment has been described in the context of using separate cards, it could also be implemented utilizing a roll of pull-tab cards, such as described in U.S. Pat. Nos. 5,348,299, 5,377,975, 5,487,544 and 5,487,544 to Clapper, all of which are hereby incorporated by reference. In this case the card reader may be internal to the dispenser and simply read the card or backing strip prior to expelling the pull-tab card. Preferably, the card reader is incorporated in the dispensing unit so that the dispensing unit can be configured to provide game credits for winning cards, thereby allowing the play to continue. Alternatively, the dispensing unit could issue cash or vouchers redeemable with a cashier for winning cards. As an additional alternative, the pull-tab cards could be dispensed by a dispensing unit, and a separate card reading unit, similar to dispensing unit 102' above but without the dispensing capability, could be used to redeem the cards.

As described above, a new game starts when a set of pull-tab cards, such as set 30 described above, is loaded, or in the case of electronic cards, transmitted, into one or more dispensing units and the jackpot is set to a predetermined value. A pull-tab card is then sold and dispensed to a player from a dispensing unit and the control system increments and displays the value of the progressive jackpot. Of course, the cards could be sold and dispensed by a human operator as well, in which case the operator would signal the control system to indicate sales of cards. The sequence of displaying, dispensing and incrementing is then repeated until the jackpot card is dispensed. When the jackpot card is dispensed, the player receiving that card is awarded the progressive jackpot.

Players receiving winning cards before or after the jackpot card is dispensed are able to redeem them for the predetermined value of the card. Thus, although the jackpot may have been awarded, the play of the game may continue until all the cards are dispensed, with the draw for players being the remaining winning cards. Alternatively, the game could be stopped as soon as the jackpot card is dispensed, or after all winning cards have been redeemed.

As mentioned above, there may be more than one jackpot card in a gaming set. One reason for including additional jack-pot cards would be to prevent a player from holding a jackpot card after receiving it. In a game where there is only one jackpot card the player receiving it would be inclined to hold the card while the game continued and the jackpot increased. This could be unfair to fellow players who would not know that they are no longer competing for the jackpot. In a game with two or more jackpot cards, the player receiving the first card would be inclined to turn it in rapidly so that another player would not get the other jackpot card and turn it in first. If there were two or more jackpot cards, the jackpot could be restarted after each jackpot card was redeemed.

It would also be possible to address the problem of a player holding the jackpot card by providing a time or current jackpot value stamp on the card. Thus, a player would only receive the jackpot value at the time the card was issued. Alternatively, the dispensing unit could read or scan the card as it was dispensed, thereby insuring detection of the jackpot card. With electronic cards, this detection would preferably occur automatically.

In the preferred embodiment, the control system may be connected to a large number of dispensing units. The control system, using identification codes and software, is able to segregate these dispensing units into various groups of one or more machines. Each group can then be used to play an independent game. Thus, if there are twenty-one dispensing units connected to the control system, they may be divided into two groups of five, a group of ten, and a group of one. Each group would then have an independent jackpot display and separate gaming set. Preferably, of course, the group with ten dispensing units would be used with a gaming set having ten times as many cards as the gaming set for the group with one dispensing unit.

In a progressive game it can be desirable to link multiple machines, and therefore more players, in a single game because the associated potential jackpot will generally go up with the number of cards making up the game. For instance, if each dispensing unit will hold 4,000 cards, then the group including ten dispensing units can be filled with a gaming set including 40,000 cards. On average, in a game with just one jackpot card, the jackpot will get to a value ten-times larger before the jackpot card is dispensed in a 40,000 card game than would be the case with a 4,000 card game.

In the preferred embodiment, the operator is provided with complete flexibility to control the parameters of the jackpot using the control system. In particular, the operator of the game can, using the software running on the control system, select the initial value of the jackpot, i.e., $0 or $500. In the preferred embodiment the operator is also able to select an increment percentage for each sale of a pull-tab card. Such values might range from a few percent to 25-percent or more. If the value was 10-percent, then for $1 cards the jackpot would be increased by 10¢ for every pull-tab card sale. The values are selected to make the game appeal to players and maintain a profit for the operator. Thus, a large initial jackpot value may be used in conjunction with a smaller percentage increment. On the other hand, a large percentage increment may be used with a small initial value. The control system is also able to track total sales and various auditing data from the dispensing units.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicant's invention.

I claim:

1. A progressive pull-tab card game system, comprising:

a pull-tab dispenser adapted to dispense pull-tab cards including indicia of redemption value, wherein the pull-tab cards include at least one jackpot card, wherein said at least one jackpot card is designated as a jackpot card by indicia on the jackpot card prior to the play of the progressive pull-tab game, wherein said indicia on the jackpot card have an undetermined total value, and further wherein each of the pull-tab cards includes a code corresponding to the indicia of redemption value of the pull-tab card;

a control system operatively connected to the dispenser to monitor the dispensing of pull-tab cards and configured to compute a jackpot value dependent on the dispensing of pull-tab cards; and an electronic display associated with the control system and configured to present a display of the indicia of redemption value on the pull-tab cards, wherein the electronic display includes a reader adapted to read the code of a pull-tab card and to present the display of the indicia of redemption value based at least partially thereupon.

2. The system of claim 1, wherein the reader is adapted to automatically read the code of a pull-tab card upon dispensing of the pull-tab card.

3. The system of claim 1, wherein the reader is adapted to read the code of a pull-tab card that is manually inserted into the reader.

4. The system of claim 1, wherein the electronic display is further configured to present a display of the jackpot value.

5. The system of claim 1, wherein the pull-tab cards are pre-printed.

6. The system of claim 1, wherein the displayed indicia of redemption value mimics the appearance of a slot machine.

7. The system of claim 1, wherein the control system is configured to compute the jackpot value by periodically incrementing a selectable initial value by a predetermined value every time a predetermined number of pull-tab cards is dispensed.

8. The system of claim 1, further including a plurality of pull-tab dispensers, where the control system is operatively connected to each dispenser to monitor the quantity of pull-tab cards dispensed.

9. The system of claim 8, wherein the control system computes the jackpot value dependent on the quantity of pull-tab cards dispensed from all of the dispensers.

10. The system of claim 1, wherein the pull-tab cards include a plurality of jackpot cards.

11. The system of claim 1, wherein the pull-tab cards further include non-jackpot cards having a predetermined value, and further wherein the non-jackpot cards are designated as non-jackpot cards by indicia of redemption on the cards prior to the play of the progressive pull-tab game.

12. The system of claim 11, wherein the non-jackpot cards include a plurality of winner cards having predetermined non-zero values, and further wherein the winner cards are designated as winner cards by indicia of redemption on the cards prior to the play of the progressive pull-tab game.

13. The system of claim 11, wherein the non-jackpot cards include a plurality of loser cards having a predetermined zero value, and further wherein the loser cards are designated as loser cards by indicia of redemption on the cards prior to the play of the progressive pull-tab game.

14. A method of operating a progressive pull-tab game, comprising:

providing a set of pull-tab plays having indicia of redemption value, wherein the set of pull-tab plays includes at least one jackpot play without a predetermined total value and a plurality of non-jackpot plays having predetermined values, wherein said at least one jackpot play is designated as a jackpot play prior to the play of the progressive pull-tab game, and further wherein said the jackpot play has an undetermined total value prior to dispensing of the jackpot play to a player;

setting a progressive jackpot to a predetermined value;

selling one of the pull-tab plays to a player;

selectively increasing the value of the progressive jackpot; and presenting to the player, by way of an electronic display, an image indicative of the value of the pull-tab play.

15. The method of claim 14, wherein the method includes displaying the progressive jackpot.

16. The method of claim 15, wherein the step of displaying is repeated every time a pull-tab play is sold.

17. The method of claim 14, wherein the selling step includes manually dispensing the play to a player.

18. The method of claim 14, wherein the selling step includes dispensing the play from a dispensing machine.

19. The method of claim 18, wherein the set of pull-tab plays takes the form of a set of pull-tab cards, wherein each pull-tab card has a selectively revealable gaming section, and further wherein the dispensing machine includes a plurality of racks containing pull-tab cards and from which a player may select a pull-tab card to be dispensed.

20. The method of claim 19, wherein the selling step is preceded by the step of allowing a player to choose a particular pull-tab dispensing unit from a plurality of pull-tab dispensing units.

21. The method of claim 20, further including the steps of distributing the set of pull-tab cards among the plurality of pull-tab dispensing units and operatively connecting the plurality of pull-tab dispensing units to a single progressive jackpot.

22. The method of claim 19, wherein each pull-tab card has a front portion, a back portion and the selectively revealable gaming section which contains indicia of a redemption value of the pull-tab card, the redemption value being unascertainable until the gaming section is revealed.

23. The method of claim 14, wherein the step of selectively increasing is repeated every time a pull-tab card is sold in the step of selling.

24. A method of conducting a progressive game, comprising:

providing a set of plays including at least one jackpot play of undetermined value and a multiplicity of non-jackpot plays with predetermined values, wherein said at least one jackpot play is designated as a jackpot play prior to the play of the progressive game, and further wherein at least prior to being distributed, the jackpot play has an undetermined total value;

distributing electronically the plays from the set of plays, where the step of distributing includes displaying on an electronic display screen information relating to the play from which the value of the play can be determined; and when the at least one jackpot play is distributed, awarding a jackpot, wherein the value of the jackpot awarded is dependent on when, in the sequence of distributing the plays, the at least one jackpot play is distributed.

25. The method of claim 24, wherein the providing step includes printing a set of plays in the form of pull-tab cards.

26. The method of claim 24, wherein the providing step includes generating an electronic set of plays.

27. The method of claim 24, wherein the providing step includes providing an electronic set of plays.

28. The method of claim 27, wherein the distributing step includes displaying indicia associated with the play in a manner that mimics the appearance of a slot machine.

29. The method of claim 24, wherein the distributing step includes displaying indicia associated with the play in a manner that mimics the appearance of a slot machine.

30. The method of claim 24, wherein the distributing step includes incrementally increasing the value of the jackpot responsive to the sequential distribution of the set of plays.

31. A progressive game system comprising:

a dispenser adapted to dispense electronically plays associated with indicia of redemption value, wherein the plays include at least one jackpot play, wherein said at least one jackpot play is designated as a jackpot play prior to the play of the progressive game, and further wherein said jackpot play has an undetermined total value prior to dispensing of the jackpot play;

a jackpot display;

a control system operatively connected to the dispenser to monitor the dispensing of plays and configured to compute a jackpot value dependent on the dispensing of plays, the control system further being operatively connected to the jackpot display to cause it to display the computed jackpot value as plays are dispensed; and an electronic display screen associated with the control system and configured to present a display of the indicia of redemption value associated with the plays.

32. The system of claim 31, further including a reader to read dispensed plays, where the display of indicia is associated with information from the reader.

33. The system of claim 31, wherein the plays are pre-printed.

34. The system of claim 31, wherein the plays are stored electronically.

35. The system of claim 31, wherein the displayed indicia of redemption value mimic the appearance of pull-tab cards.

36. The system of claim 35, wherein the electronic display screen is adapted to receive user inputs and further wherein the control system is adapted to selectively display the indicia responsive at least in part to the user inputs.

37. The system of claim 31, wherein the displayed indicia of redemption value mimic the appearance of a slot machine.

38. The system of claim 31, wherein the control system is configured to compute the jackpot value by periodically incrementing a selectable initial value by a predetermined value every time a predetermined number of plays is dispensed.

39. The system of claim 31, further including a plurality of play dispensers, where the control system is operatively connected to each dispenser to monitor the quantity of plays dispensed.

40. The system of claim 39, wherein the control system computes the jackpot value dependent on the quantity of plays dispensed from all of the dispensers.

* * * * *